US007757520B2

(12) United States Patent
Kim et al.

(10) Patent No.: US 7,757,520 B2
(45) Date of Patent: Jul. 20, 2010

(54) STEAM GENERATOR AND DRUM TYPE WASHING MACHINE WITH THE SAME

(75) Inventors: Kyeong Hwan Kim, Seoul (KR); Si Moon Jeon, Seoul (KR); Kyung Chul Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 571 days.

(21) Appl. No.: 11/785,081

(22) Filed: Apr. 13, 2007

(65) Prior Publication Data

US 2007/0240458 A1 Oct. 18, 2007

(30) Foreign Application Priority Data

Apr. 13, 2006 (KR) ..... 10-2006-0033631

(51) Int. Cl.
*D06F 39/04* (2006.01)

(52) U.S. Cl. ..... 68/15; 392/441; 134/105

(58) Field of Classification Search ..... 68/15, 68/207; 134/105, 108
See application file for complete search history.

(56) References Cited

U.S. PATENT DOCUMENTS

| | | | | | |
|---|---|---|---|---|---|
| 2,458,103 | A | * | 1/1949 | Schwartz | 392/401 |
| 2,843,720 | A | * | 7/1958 | Young | 219/441 |
| 3,436,851 | A | * | 4/1969 | Gilbert | 38/69 |
| 3,918,355 | A | * | 11/1975 | Weber | 99/283 |
| 4,414,037 | A | * | 11/1983 | Friedheim | 134/35 |
| 5,471,556 | A | * | 11/1995 | Friedheim | 392/399 |
| 6,377,750 | B1 | * | 4/2002 | Scott et al. | 392/441 |
| 6,431,058 | B1 | * | 8/2002 | Binot et al. | 99/331 |
| 6,948,419 | B2 | * | 9/2005 | Pan et al. | 99/281 |

FOREIGN PATENT DOCUMENTS

| | | | |
|---|---|---|---|
| DE | 25 34 701 | * | 7/1977 |
| DE | 200 04 403 | U1 | 5/2000 |
| DE | 200 01 833 | * | 7/2000 |
| DE | 201 04 765 | U1 | 6/2001 |
| EP | 1 507 029 | A2 | 2/2005 |
| EP | 1 507 029 | A3 | 3/2005 |
| EP | 1 544 345 | A2 | 6/2005 |
| EP | 1 616 990 | A1 | 1/2006 |
| GB | 2 080 343 | A | 2/1982 |
| JP | 03-018312 | * | 1/1991 |
| JP | 06-253754 | * | 9/1994 |
| JP | 07-098157 | * | 4/1995 |
| JP | 08-308734 | * | 11/1996 |

* cited by examiner

*Primary Examiner*—Frankie L Stinson
(74) *Attorney, Agent, or Firm*—McKenna Long & Aldridge LLP

(57) ABSTRACT

A steam generator includes a case that forms a predetermined space for storing water, a heater provided within the case, a sealing member for preventing water leakage from the case, and a pressure part to press the sealing member and the heater. The sealing member is also configured to secure and seal the heater such that water is prevented from penetrating or leaking toward a circuit part of the heater. A drum-type washing machine having the steam generator installed therein is also disclosed.

21 Claims, 11 Drawing Sheets

STEAM GENERATOR AND DRUM TYPE WASHING MACHINE WITH THE SAME

This application claims the benefit of Korean Patent Application No. 10-2006-0033631, filed on Apr. 13, 2006, which is hereby incorporated by reference for all purposes as if fully set forth herein.

BACKGROUND

1. Field of the Disclosure

The present invention relates to a steam generator. More particularly, the present invention relates to a steam generator in a drum-type washing machine having a compact design to facilitate a sealing process and achieve great sealing results.

2. Discussion of Related Art

Generally, laundry devices are home appliances that can perform washing, drying and sterilizing operation on laundry such as various items, fabrics, beddings, clothes or the like. Laundry devices include washing machines, dryers and appliances having both washing and drying functions.

A washing machine may include a pulsator and a tub that are rotated to perform a washing, rinsing, and spinning cycle. More specifically, once wash water and laundry are introduced into the tub and agitated, the washing machine performs washing by using friction force between the wash water and the tub.

Washing machines are often categorized based on the type of method, which is used to perform washing. For example, washing machines can be categorized as a pulsator-type washing machine, an agitating-type washing machine or a drum-type washing machine.

A drum-type washing machine performs washing by rotating a horizontally oriented drum to produce a frictional force between the wash water and the laundry, once detergent, wash water and laundry are introduced into a drum.

Of the three aforementioned types, the drum-type washing machine is often desirable because it consumes less wash water and less detergent than the other types, while reducing damage to the laundry fabrics. Also, the drum-type washing machine washes laundry as if it were scrubbed by human hands, but with less entanglement.

In order to provide a drum-type washing machine that consumes less wash water, studies and efforts have been made in connection with washing of the drum-type washing machine.

Recently, a steam generator is included in the drum-type washing machine to help washing with much less wash water.

In reference to FIGS. 1 and 2, a conventional drum-type washing machine will be described as follows.

A conventional drum-type washing machine includes a body 1, a drum 2, a tub 3 and a steam generator 4. The body 1 defines an exterior of the drum-type washing machine and the drum 2 holds laundry therein. The tub 3 surrounds the drum 2 and the steam generator 4 is installed within the body 1 to produce steam.

An opening 1*a* is formed in a front surface of the body 1 through which laundry is loaded and unloaded from the drum 2. A door 1*b* is coupled to the opening 1*a* and rotates to open and close the opening 1*a*.

As shown in FIG. 2, the steam generator 4 includes a steam outlet 4*a* and a water inlet (not shown), a case 4*c*, a sheath heater 4*d*, a water level sensor 4*e* and a water temperature sensor 4*f*. The steam outlet 4*a* and the water inlet are formed in predetermined sides of the steam generator 4. The case 4*c* holds water and the sheath heater 4*d* heats the water. The water level sensor 4*e* senses a water level inside the case 4*c*. The water temperature sensor 4*f* senses the temperature inside the case 4*c*.

The case 4*c* includes an upper case and a lower case that are fastened to each other.

Water supplied to the steam generator 4 passes through the water inlet 4*b*. The water level sensor 4*e* senses the level of the water so that the steam generator is able to maintain the appropriate amount of water.

The sheath heater 4*d* heats the water and steam is produced. The steam passes through the steam outlet 4*a* into the drum 2. The temperature sensor 4*f* senses the temperature of the sheath heater 4*d* so that the temperature of the sheath heater 4*d* can be controlled to be below a predetermined temperature to prevent the sheath heater 4*d* from over-heating.

However, according to the conventional drum-type washing machine, the sheath heater 4*d* has a low power density and the size of the sheath heater 4*d* should be relatively large to produce the amount of steam required for a drum-type washing machine with a large capacity.

As a result, the overall volume of the steam generator 4 is increased in order to accommodate the sheath heater 4*d*. However, the space necessary to install the steam generator 4 in the body 1 of the washing machine is limited.

Furthermore, if a plate heater is provided to solve this disadvantage, an end portion between the upper case and the lower case and an edge of the plate heater should be separately sealed to prevent water leakage from the case 4*c* and prevent water from penetrating through a circuit part of the plate heater.

However, such a sealing method is difficult and deteriorates work efficiency.

SUMMARY

Accordingly, the present invention relates to a steam generator and a drum-type washing machine having the same.

An advantage of the present invention is to provide a steam generator in a home appliance having a compact design and overcome a space limitation when the steam generator is installed in a drum-type washing machine.

Another advantage of the present invention is to perform a sealing process necessary in various structures at the same time with ease.

Additional advantages and features of the disclosure will be set forth in part in the description which follows and in part will become apparent to those having ordinary skill in the art upon examination of the following or may be learned from practice of the invention. The advantages of the invention may be realized and attained by the structure particularly pointed out in the written description and claims, as well as the appended drawings.

To achieve these advantages and in accordance with the purpose of the invention, as embodied and broadly described herein, a steam generator includes a case that forms a determined space to accommodate water; a heater provided within the case; a sealing member for preventing water leakage from the case, wherein the sealing member seals the heater to prevent water from penetrating through a circuit part of the heater; and a pressure part for pressing the sealing member and the heater.

Here, it is preferred that the heater is a plate heater.

In one example, the case may include an upper case and a lower case, fastened to the upper case. The pressure part may be extended from either of the upper and lower case to the other. The pressure part may include a plurality of separated legs.

In another example, the case may include at least one upper fastening part formed along a rim of the upper case and at least one lower fastening part formed along a rim of the lower case. The lower fastening part is formed to correspond to the upper fastening part.

The lower case may include a bent piece bent inward from a lower end of the lower case, a bottom surface of the lower case an opening. The sealing member may include a first sealing member provided between the bent piece and the heater, and a second sealing member provided on a portion where the upper case is contacted with the lower case.

The steam generator may include at least one projection projected at a rim of either the upper case or the lower case; and at least one two-step groove part formed at a rim of the other, wherein the two-step groove part comprises an inserting groove in which the projection is inserted and an engaging groove to which the projection is insertedly engaged by rotation of the lower case.

The steam generator may further include a water level sensor provided in the upper case to sense a water level; a partition wall extended from a bottom surface of the upper case to prevent access of foreign substances to the water level sensor and malfunction of the water level sensor caused by water waves.

The steam generator may further include a water drain part, wherein the water drain part comprises a water drain hole through which water inside the lower case is drained, and a cover for selectively opening and closing the water drain hole. A bottom surface of a lower case may be oblique and oriented toward the water drain hole to direct the flow of water toward the drain hole so that water may flow out of the drain hole with ease.

The steam generator may further include a fixing bracket connected to the upper case or the lower case, wherein the fixing bracket fixes the upper case and the lower case to a fastening hole formed at a predetermined supporting part. It is preferred that the fixing bracket may include a bent part fastened to the fastening hole to prevent the fixing bracket from being separated from the fastening hole.

In another aspect of the present invention, a steam generator includes a lower case that holds water therein; a heater provided in the lower case to heat the water; a sealing member provided in the lower case; and an upper case that presses the heater and the sealing member to prevent water leakage.

The lower case may include a bent piece bent inward from a lower end of the lower case, a bottom surface of the lower case being opened. The sealing member may include a first sealing member provided between the bent piece and the heater, and a second member provided on a portion where the lower case is contacted with the upper case.

It is preferred that a bottom surface of the lower case is oblique and oriented downward to a water drain hole to allow the water to flow toward and out of the drain hole with ease.

The steam generator may further include a fixing bracket connected to the upper case of the lower case. The fixing bracket fixes the upper case and the lower case to a fastening hole formed at a predetermined supporting part. The predetermined supporting part may be attached to a home appliance.

In another aspect, a drum-type washing machine includes a drum rotatable within the tub; and a steam generator that produces steam and supplies the steam into the drum. The steam generator includes a case that forms a predetermined space to accommodate water; a heater provided within the case; a sealing member for preventing water leakage from the case, wherein the sealing member seals the heater to prevent water from penetrating through a circuit part of the heater; and a pressure part for pressing the sealing member and the heater.

The steam generator includes a plate heater and thus the heating capacity is enhanced. Also, the size of the steam generator is compact such that the steam generator does not occupy a significant amount of space and thus the inner space utility of the drum-type washing machine can be enhanced.

Furthermore, since the pressure part is provided in the upper case, the sealing for preventing water leakage and the sealing for preventing steam leakage from the lower case are able to formed at the same time or in a single process.

As a result, the steam generator advantageously decreases manufacturing costs , increases work efficiency, and increases production efficiency.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain principles of the disclosure. In the drawings.

DETAILED DESCRIPTION OF THE ILLUSTRATED EMBODIMENTS

Reference will now be made in detail to specific embodiments, examples of which are illustrated in the accompanying drawings. Wherever possible, the same reference numbers will be used throughout the drawings to refer to the same or like parts.

Figure 3:
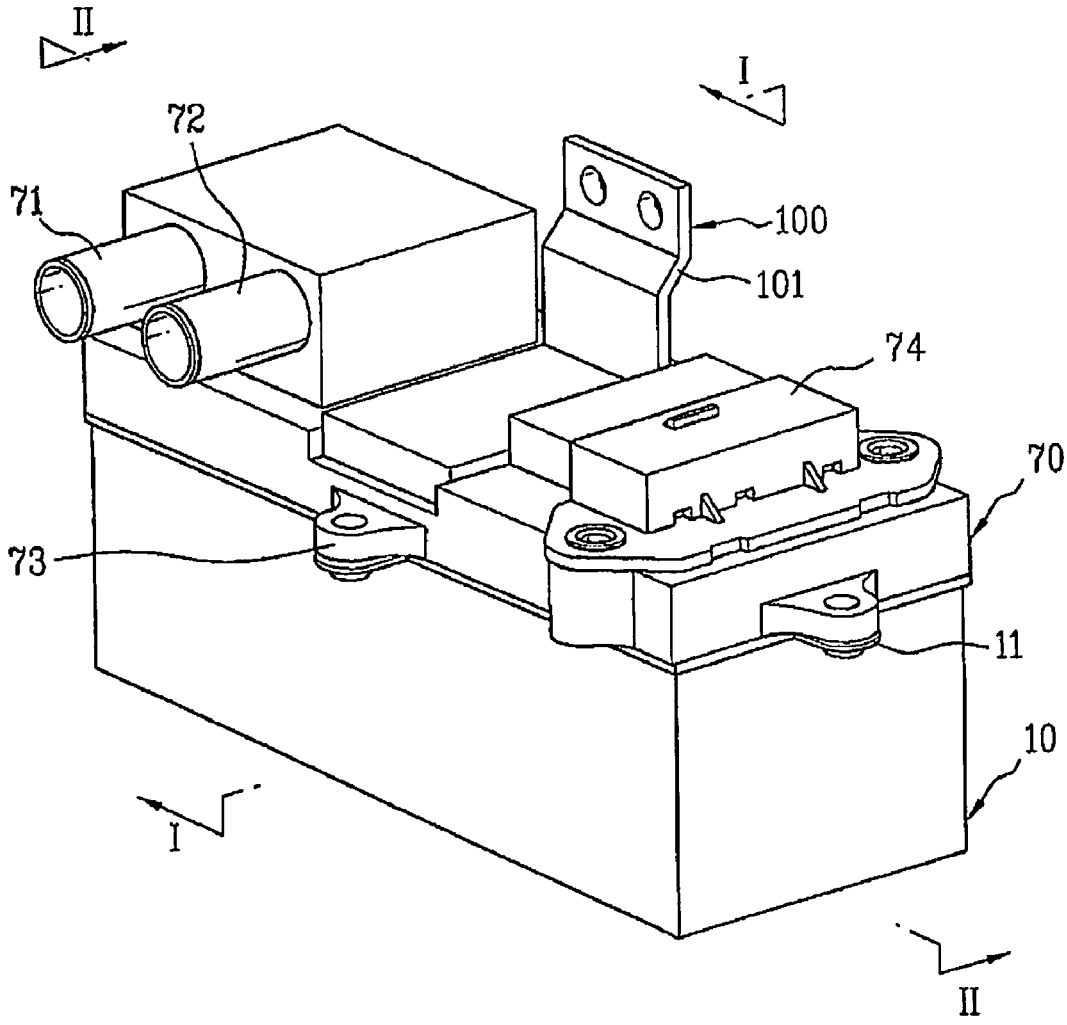
FIG. 3 is a perspective view illustrating a steam generator according to a first embodiment.
Figure 4:
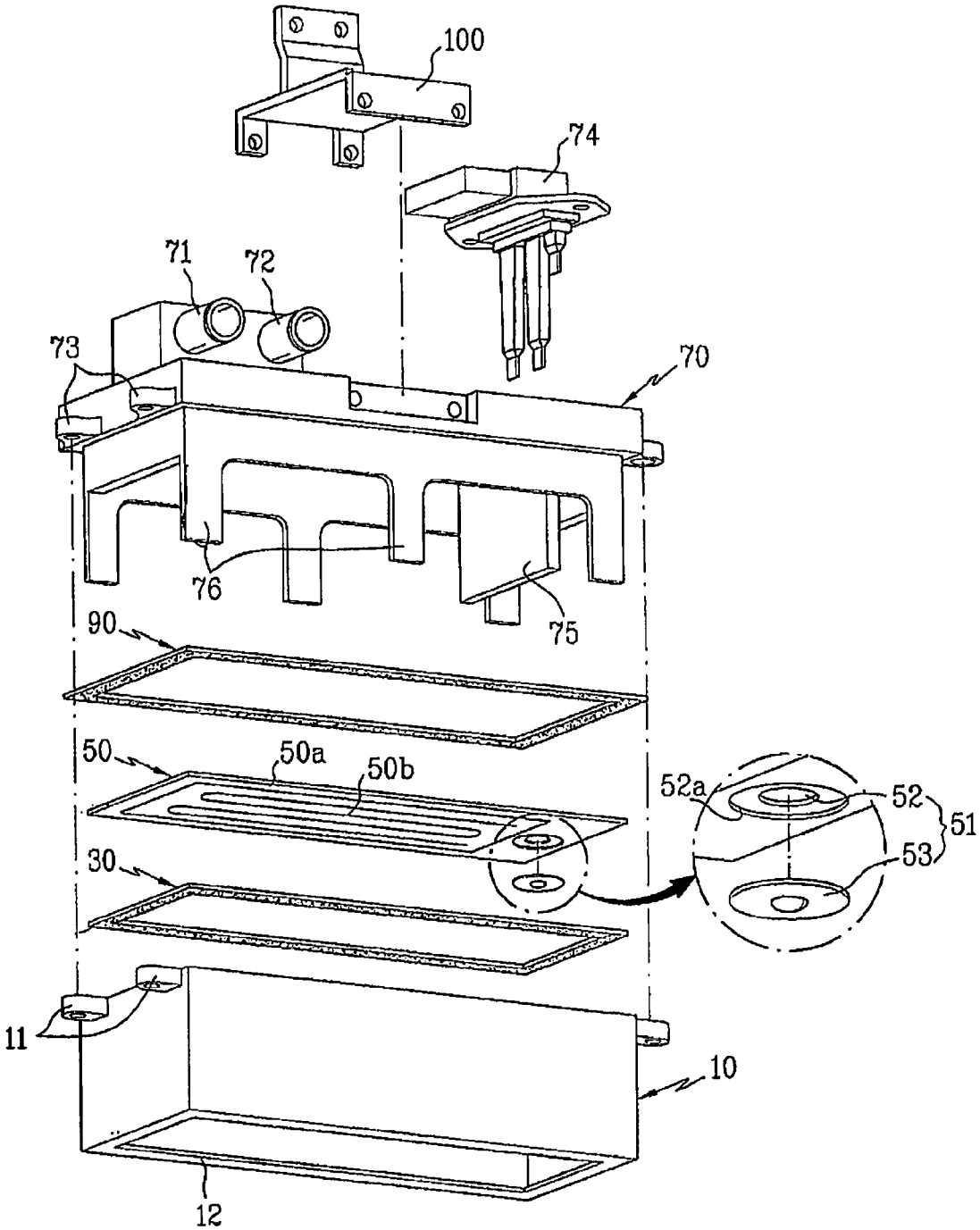
FIG. 4 is a exploded perspective view illustrating the steam generator according to the first embodiment.

As shown in FIGS. 3 and 4, a steam generator according to a first embodiment includes a case 10 and 70, a sealing member 30 and 90, a heater 50 and a pressure part 76. The case includes a lower case 10 and an upper case 70.

The lower case 10 may define a predetermined space for storing water. At least one lower fastening part 11 is formed on or substantially adjacent to a rim of the lower case 10.

A bottom surface of the lower case 10 may include an opening or an opened portion. A lower end of the lower case 10 may be bent to form a bent piece 12, which is adjacent to the opening. The bent piece 12 is bent inward toward a center of the lower case 10. The bent piece 12 is structured such that the heater 50 is able to be seated in the lower case 10 and connected to electrical devices with ease.

Figure 6:
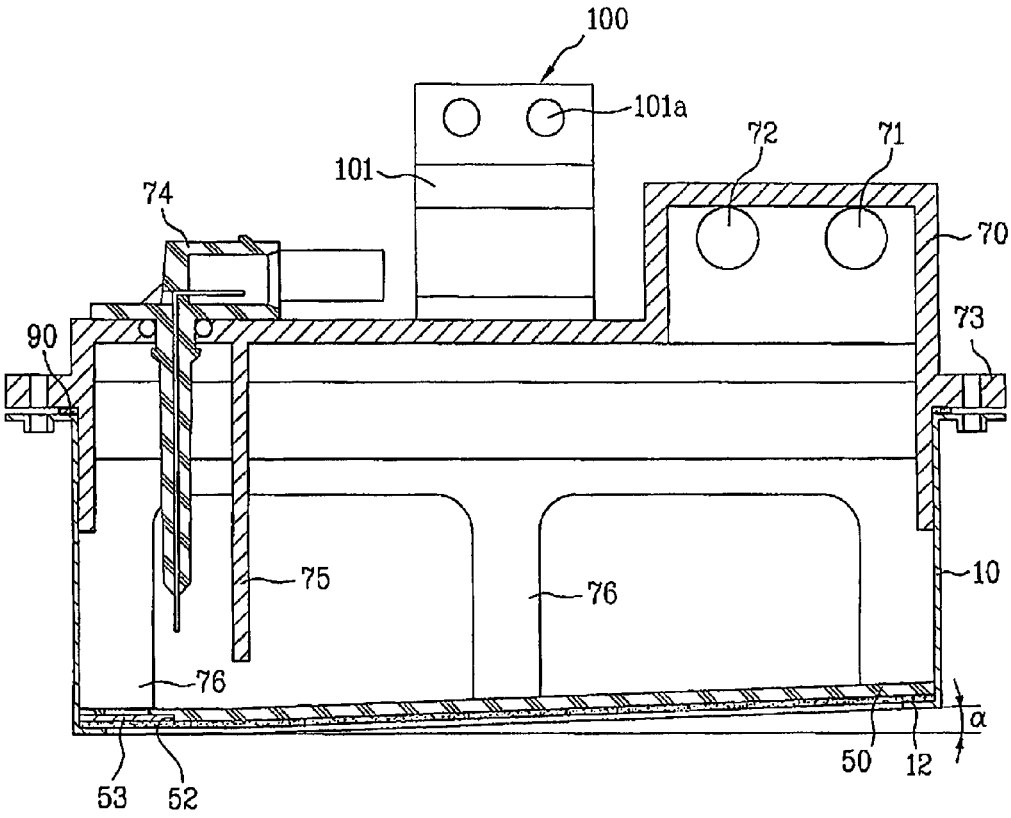
FIG. 6 is a sectional view of II-II line shown in FIG. 3.

As shown in FIG. 6, the bottom surface of the lower case 10 may be oblique. That is, the bottom surface of the lower case 10 may be oblique and sloped at a predetermined angle ($\alpha$). The bottom surface of the lower case is sloped or inclined such that the water flows smoothly toward, through, and out of the water drain hole 52. As a result, the steam generator is able to drain substantially all of the water from inside the lower case 10.

The sealing member is formed of a first member 30 and a second member 90. The first sealing member 30 prevents the water inside the lower case 10 from penetrating between the heater 50 and the lower case 10. The sealing member may also be employed as a pad for the motor. Thus, it is preferred that the first sealing member 30 comprises or is fabricated with a flexible material.

The first sealing member 30 is configured to prevent water leakage. The first sealing member 30 is also configured to prevent a heating wire of the heater 50 from making contact with water. Such contact might cause a heating wire to malfunction. Thus, the first sealing member 30 may be configured to prevent heater malfunction. Furthermore, the first sealing member 30 may prevent damage to both the metal heater 50 and a synthetic lower case 10 because it prevents the heater 50 and the lower case 10 from directly contacting each other.

The first sealing member 30 may be provided on the bent piece 12 of the lower case 10. The first sealing member 30 may be formed as one body or formed of a plurality of separate pieces.

The heater 50 heats the water supplied to the lower case 10. It is preferred that the heater 50 is a plate heater.

By possessing good heat-resisting/heat-insulating properties and a small-thin plate shape, the plate heater 50 can be used in a small space efficiently. Also, because of its plate shape, the plate heater 50 can uniformly heat heating objects and also quickly change its temperature.

The plate heater 50 includes a body 50*a* and a heating wire 50*b*. The body 50*a* comprises or is fabricated with a high heat-conductive material. The heating wire 50*b* comprises or is installed on some portion of the body 50*a* that is exposed outside, for example, an exterior bottom surface of the body 50*a*. The heating wire 50*b* is bent several times to be uniformly arranged on the bottom surface of the body 50*a*.

The plate heater 50 is seated on the first sealing member 30. The plate heater 50 closes the opened bottom surface of the lower case 10. The plate heater 50 may form or function as a bottom surface of the lower case 10.

The heating wire 50*b* is installed on a predetermined surface of the plate heater 50. The predetermined surface may be exposed outside such that the water supplied to the lower case 10 does not directly contact the heating wire 50*b*. For example, the heating wire 50*b* may be formed on an exterior surface of the plate heater 50, which forms a bottom of the lower case.

Also, a water drain part 51 may be formed on the predetermined surface of the heater 50, such that the water supplied to the lower case 10 may be drained outside the case with ease.

It is preferred that the water drain part 51 is formed on a lower portion of the oblique surface. As a result, the water can flow to the lower portion when the water is drained so that substantially no water remains in the case when the water drain hole is not covered.

The water drain part 51 includes a water drain hole 52 and a cover 53. The water drain hole 52 is formed on a predetermined surface of the heater 50 and the cover 53 selectively covers the water drain hole 52. It is preferred that the water drain hole 52 is formed on a portion in which the heating wire 50*b* is not present or passing there through.

As shown in FIG. 4, the water drain hole 52 has a stepped part 52*a* that is structured to function as a stopper. When the cover 53 covers the water drain hole 52, the stepped part 52*a* keeps the cover 53 from going into the lower case 10 even when force is applied to the cover 53.

A hand grip may be provided on a predetermined portion of the cover 53. The predetermined portion may be on a surface that is opposite to the surface, where the water drain hole 52 is in contact with the cover 53. By using the hand grip, a user can easily manipulate the cover 53 to open/close the water drain hole 52.

The upper case 70 is fastened to an upper portion of the lower case 10 and may define an upper part of the steam generator.

A steam outlet 71 and a water inlet 72 are provided in the upper case 70. An upper fastening part 73 is formed to correspond to the lower fastening part 11 of the lower case 10.

A water level sensor 74 is installed in the upper case 70. The water level sensor 74 is configured to detect or sense a water level of the water supplied to the lower case 10. A temperature sensor (not shown) is installed in the upper case 70 and senses the temperature of the plate heater 50 to maintain a predetermined temperature to prevent the plate heater 50 from overheating.

A partition wall 75 may be formed on the upper interior surface of the upper case 70 adjacent to the water level sensor 74. The partition wall 75 extends downward from the upper surface of the upper case 70 such that the partition wall is substantially perpendicular with an upper surface of the upper case 70. The partition wall 75 may be structured to prevent or obstruct foreign substances from reaching the water level sensor 74. The partition wall 75 may also prevent or obstruct disturbances, such as water waves, from reaching the water level sensor 74 when the water is boiled.

When the upper case 70 is fastened to the lower case 10, a lower end of the partition wall 75 may be spaced from an upper surface of the heater 50 by a predetermined distance.

At least one pressure part 76 may be provided to the upper case 70. The pressure part is configured to press against or apply pressure to the plate heater 50 when the lower case 10 is fastened to the upper case 70. The pressure part 76 extends downward from a rim of the upper case.

The pressure part 76 presses the plate heater 50 and thus the plate heater 50 presses the first sealing member 30 to the lower case 10 to secure the sealing between the plate heater 50 and the lower case 10. In this example, the pressure part 76 is formed along the rim of the upper case 70. It is preferred that the pressure part 76 includes a plurality of separate legs.

A second sealing member 90 may be provided between the upper case 70 and the lower case 10. The second sealing member 90 is provided on a portion where the lower case 10 is in contact with a portion of the upper case 70, to prevent water leakage and steam leakage. Thus, it is preferred that the second sealing member 90 comprises or is made of flexible material like the first sealing member 30.

The second sealing member 90 may be formed along the rim of the upper case 70 as a single integrated body. Alternatively, the second sealing member 90 may be formed of a plurality of pieces.

Figure 1:
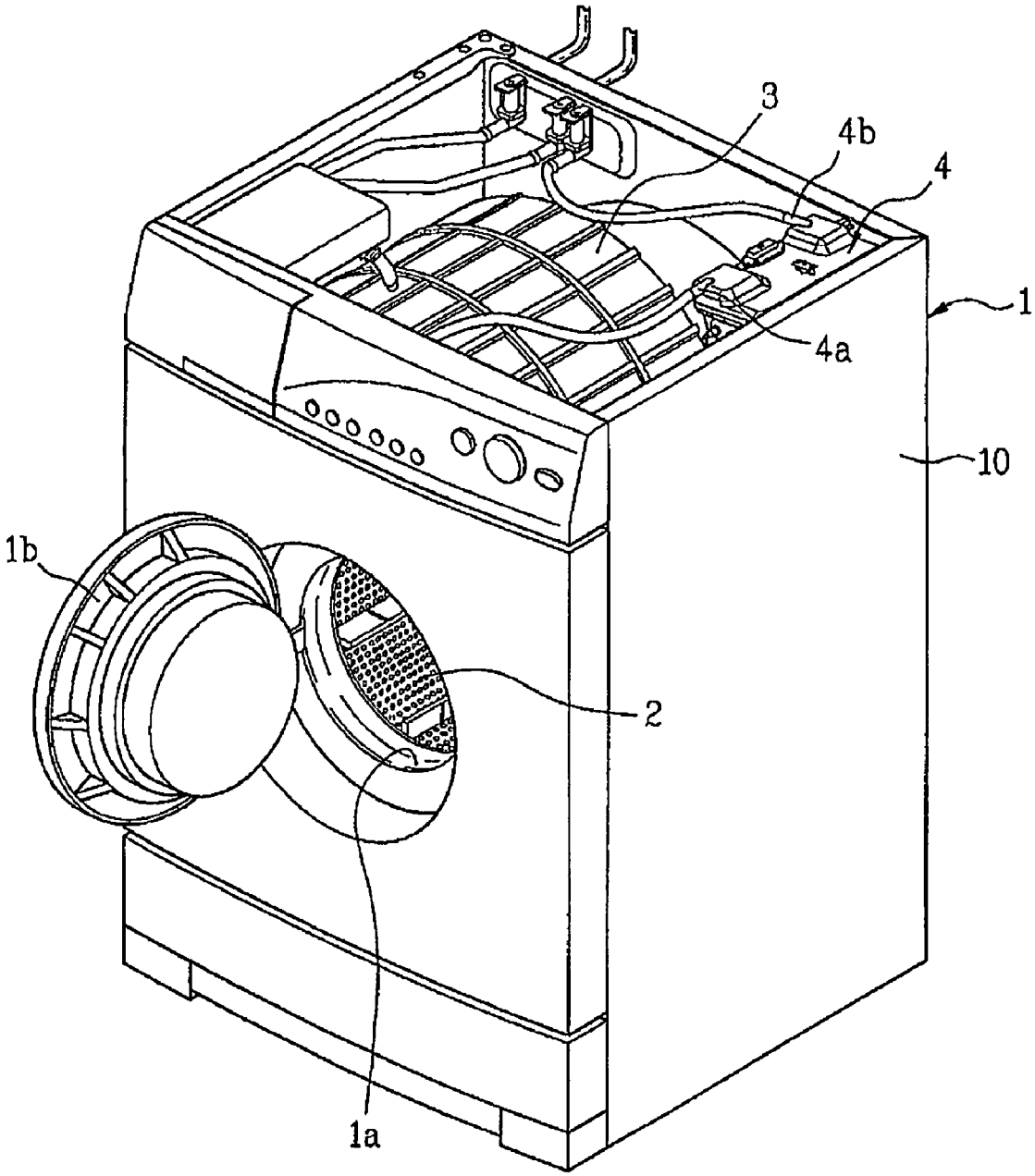
FIG. 1 Related Art
FIG. 1 is a perspective view illustrating a conventional drum-type washing machine.
Figure 2:
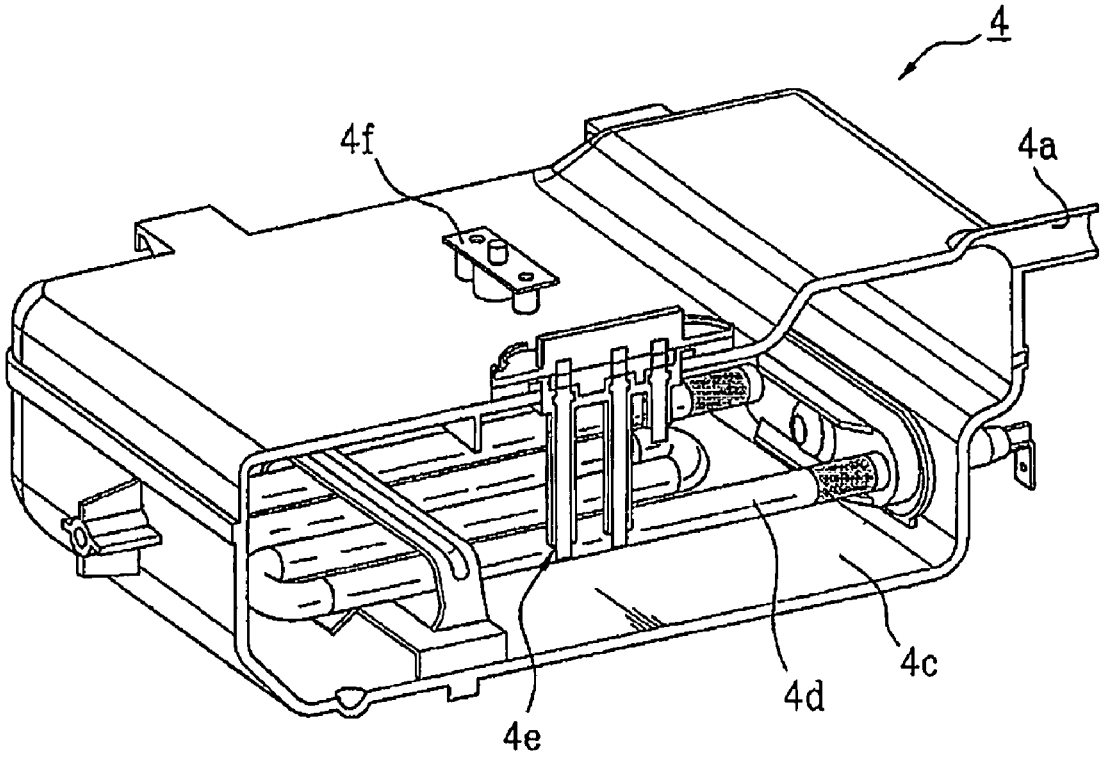
FIG. 2 Related Art
FIG. 2 is a cut-away perspective view illustrating a steam generator of the conventional drum-type washing machine.
Figure 7:
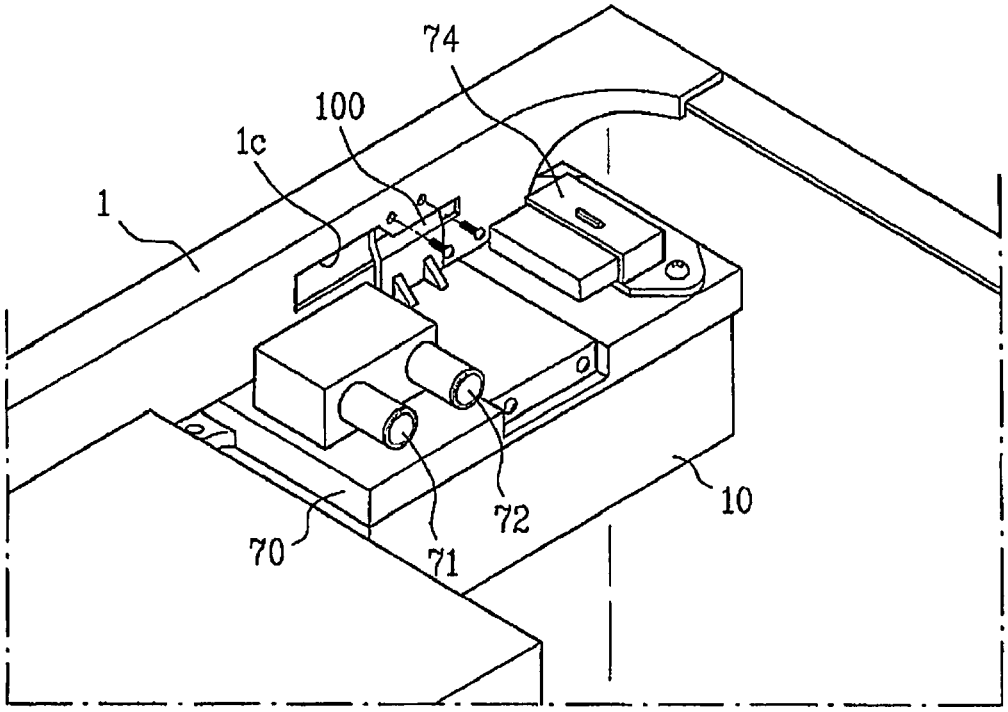
FIG. 7 is a perspective view illustrating key parts of a drum type washing machine in which the steam generator according to the first embodiment is installed.
Figure 8:
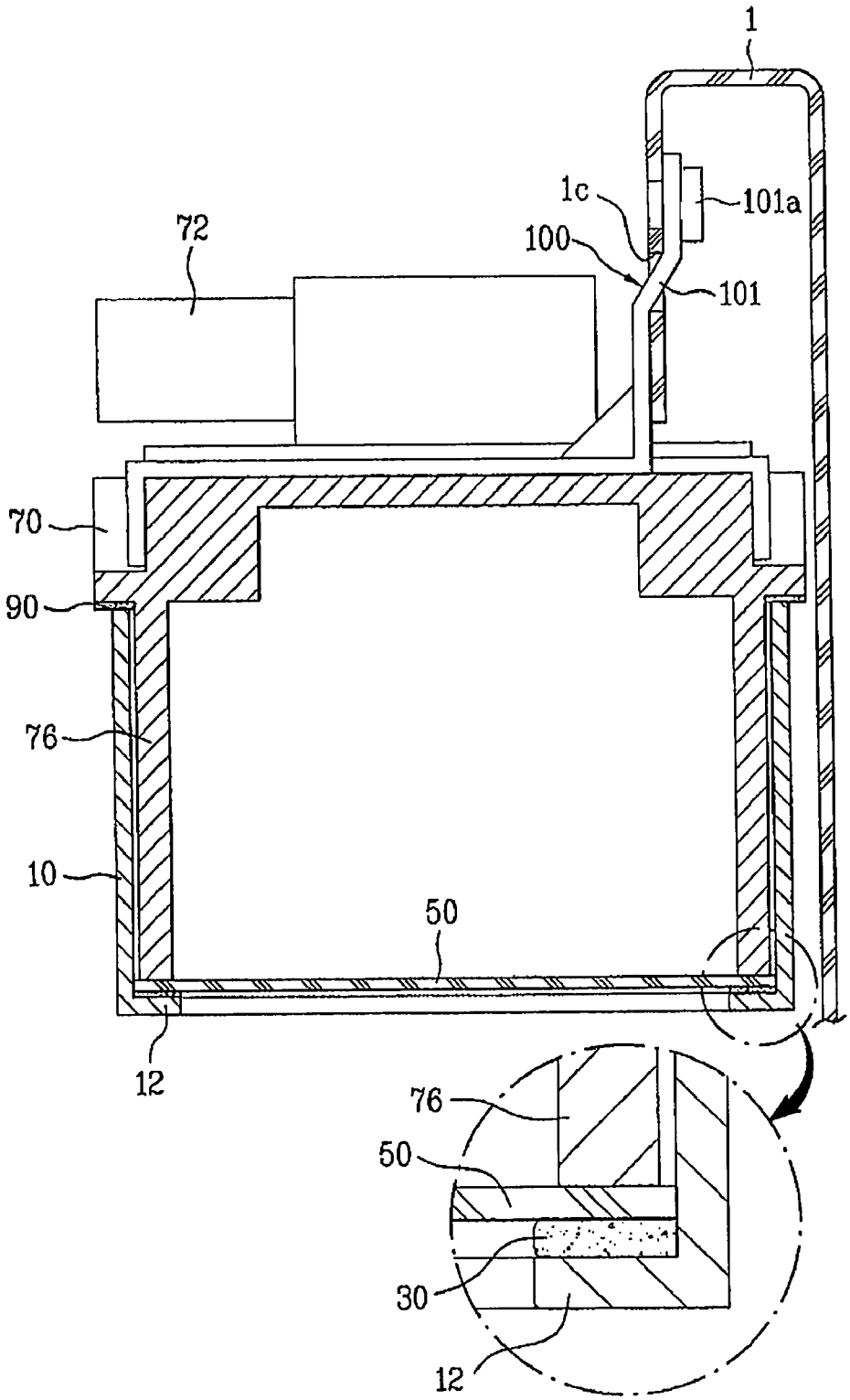
FIG. 8 is a sectional view illustrating the drum-type washing machine in which the steam generator according to the first embodiment is installed.

Furthermore, a fixing bracket 100 may be provided on the upper case 70 to fix the steam generator to the drum-type washing machine. As shown in FIGS. 7 and 8, a fastening hole 1*c* may be formed on the cabinet 1 (see FIG. 1), which defines an exterior of the drum-type washing machine. The fixing bracket 100 may be fixed in the fastening hole 1*c*.

Also, the fixing bracket 100 may further include a bent part 101 fastened to the fastening hole 1*c* to prevent the fixing bracket 100 from being separated from the fastening hole 1*c*.

As shown in FIG. 8, the bent part 101 may be bent twice or at more than one location along the fixing bracket 100 to be supported by the fastening hole 1*c*. Thus, the steam generator may be pre-assembled to the drum-type washing machine prior to a screw fastening process to facilitate the assembling work and process. Alternatively, the fixing bracket 100 may be provided on the lower case 10.

Figure 5:
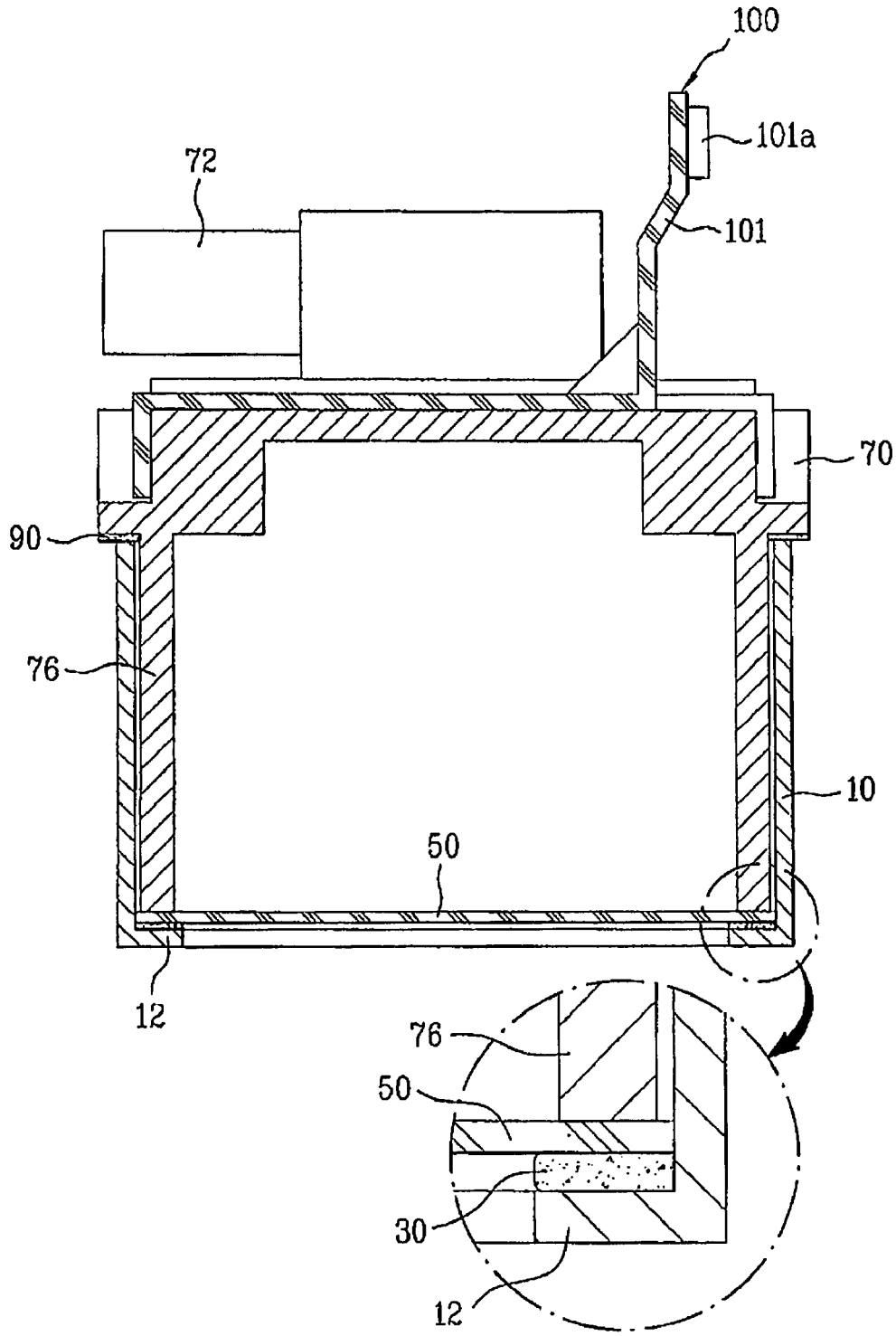
FIG. 5 is a sectional view of I-I line shown in FIG. 3.

Referring to FIGS. 5 and 6, an assembly process and operation of the steam generator according to the first embodiment will be now explained.

First, the first sealing member 30 is seated on the upper surface of the bent piece 12 of the lower case 10 and the plate heater 50 is seated on the upper surface of the first sealing member 30. In this example, the portion of the plate heater 50, where the water drain part 51, is formed is disposed on substantially the lowermost portion of an oblique surface of the lower case 10.

The second sealing member 90 is seated on the portion where the upper case 70 and the lower case 10 contact each other. The upper case 70 is positioned above the lower case and fastened to the lower case 10 by at least the second sealing member 90.

The pressure part 76, which may extend from the upper case 70, is accommodated within the lower case 10. The lower end of the pressure part 76 is in contact with the plate heater 50.

The second sealing member 90 is in contact with the upper end of the lower case 10. The upper case 70 and the lower case 10 are arranged such that the upper fastening part 73 of the upper case 70 corresponds to the lower fastening part 11 of the lower case 10. In this example, because of the thickness of the second sealing member 90, the upper fastening part 73 is spaced from the lower fastening part 11 by a predetermined distance.

Next, a screw is inserted through the upper fastening part 73 and the lower fastening part 11, such that the upper case 70 is fastened to the lower case 10. In this example, the screw fastening lessens the spaced distance between the upper case 70 and the lower case 10. As a result, the upper case 70 and the lower case 10 are closely disposed, having the second sealing member 90 there between.

As the upper case 70 and the lower case 10 are closely disposed, the pressure part 76 automatically presses the plate heater 50. The plate heater 50 presses the first sealing member 30. As a result, the bottom surface of the plate heater 50 and the upper surface of the bent piece 12 are closely disposed, while having the first sealing member 30 there between.

The sealing between the upper and lower cases 70 and 10 may be performed simultaneously with the sealing between the plate heater 50 and the lower case 10.

The steam generator is fixed to the cabinet 1 of the drum-type washing machine by using the fixing bracket 100 provided on the upper case 70.

The bent part 101 of the fixing bracket 100 is hooked and fastened to the fastening hole 1*c* so that the steam generator may be preassembled or attached to the drum-type washing machine prior to the screw fastening process. The bent part 101 is hooked to the cabinet 1 where the fastening hole 1*c* is formed, to support the steam generator.

A screw hole is formed in the cabinet 1. The screw hole of the cabinet corresponds to a screw hole 101*a* formed in the bent part 101. A screw is inserted into the screw hole of the cabinet and the screw hole 101*a* of the bent part 101 and fastened such that the steam generator is fixed to the drum-type washing machine.

The first embodiment of fastening the upper case to the lower case by screw-fastening been described.

A second embodiment will now be explained in which the upper case is engaged to the lower case.

The same reference numerals are given configurations of the second embodiment that are the same or similar as those configurations of the first embodiment.

Figure 9:
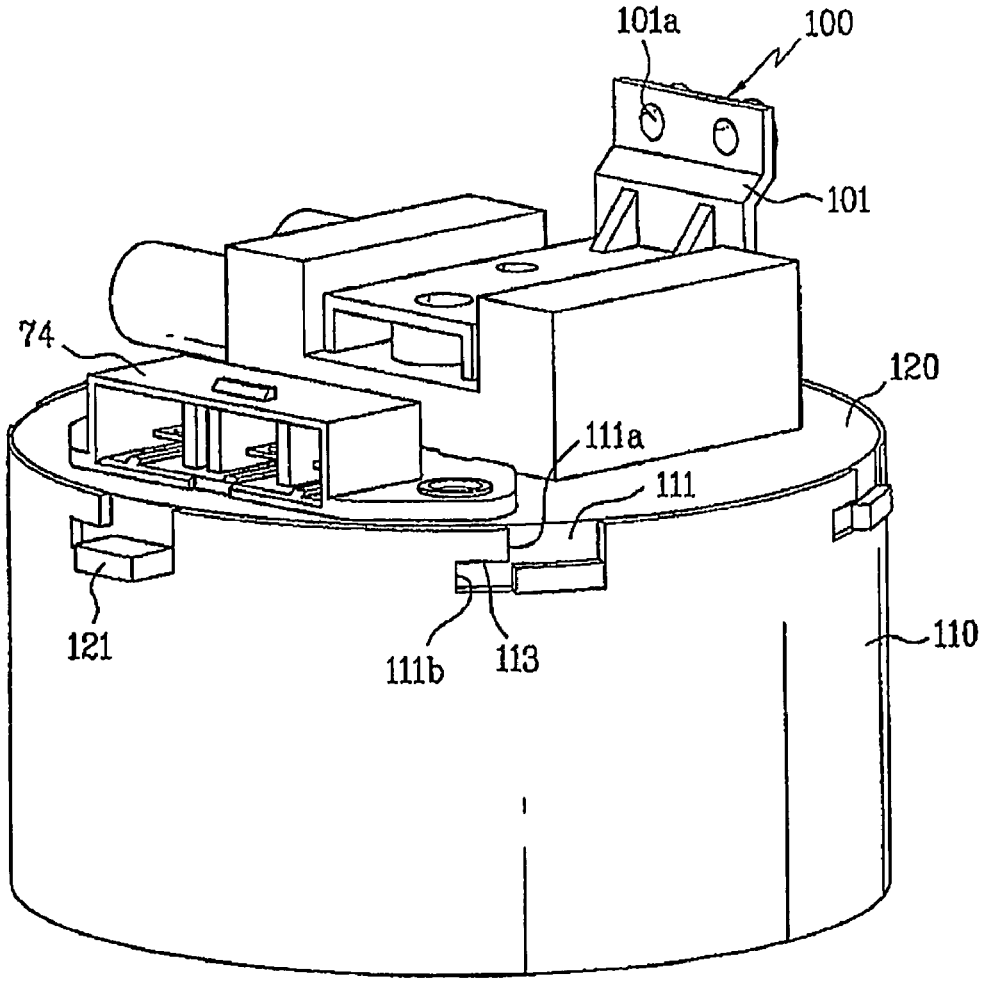
FIG. 9 is a perspective view illustrating a steam generator according to a second embodiment.

As shown in FIG. 9, a steam generator according to the second embodiment includes a lower case 110 and an upper case 120. The lower case 110 comprises a cylindrical shape and at least one two-step groove part 111. The upper case 120, which is positioned above the lower case 110 and fastened to the lower case 110, comprises a cylindrical shape and at least one projection 121. In this example, the shape of the lower case 110 corresponds to the shape of the upper case 120.

A pressure part 130 (see FIG. 10*a*) extends toward plate heater 140. The pressure part 130 of the second embodiment may be identical or similar to the pressure part of the first embodiment.

A plurality of two-step groove parts 111 may be formed along an upper circumferential portion of the lower case 110. The two-step groove part 111 includes an inserting groove 111*a* in which the projection 121 is inserted and an engaging groove 111*b* to which the projection 121 is engaged by the rotation of the lower case 110 or rotation of the upper case. The projection 121 is structured to be inserted in the inserting groove 111*a*.

A step 113 is formed between the inserting groove 111*a* and the engaging groove 111*b*. The step 113 prevents the upper case 120 from being separated from the lower case 110.

The projection 121 is formed along a circumference of the upper case 120, corresponding to the two-step groove part 111. The projection 121 projects outward or protrudes from the circumferential portion of the upper case 120.

Figure 10A:
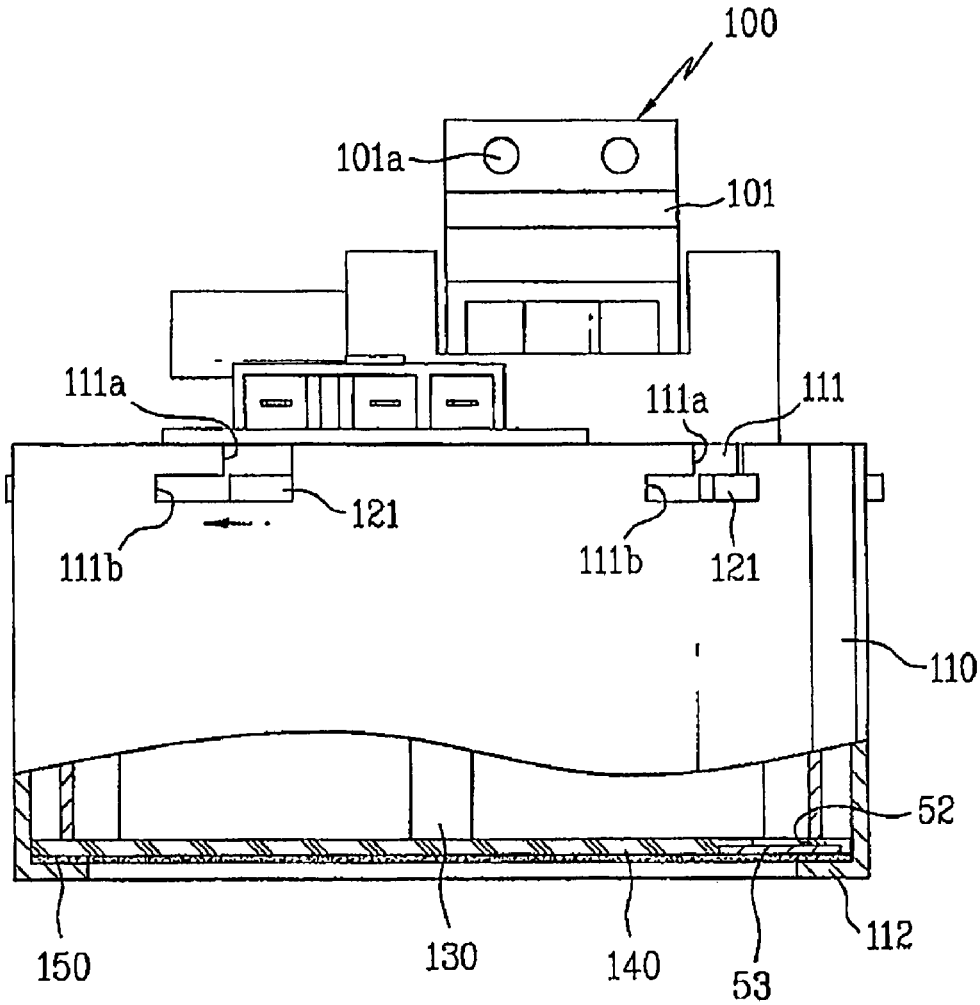
FIGS. 10*a* and 10*b* are diagrams that respectively illustrate before and after states of an upper case being fastened to a lower case according to the second embodiment.

A bottom surface of the lower case 110 includes an opened portion and a bent piece 112 (see FIG. 10*a*). The bent piece 112 is bent inward from an end of the bottom surface and toward a center of the case. A circular first sealing member 150 (see FIG. 10*a*) is seated on the bent piece 112.

A plate heater 140 is seated on an upper surface of the first sealing member 150 (see FIG. 10*a*). The plate heater 140 closes an opened bottom portion of the lower case 110. A heating wire may be installed on an exposed surface of the plate heater 140. The exposed surface may form an exterior of the case.

Figure 10B:
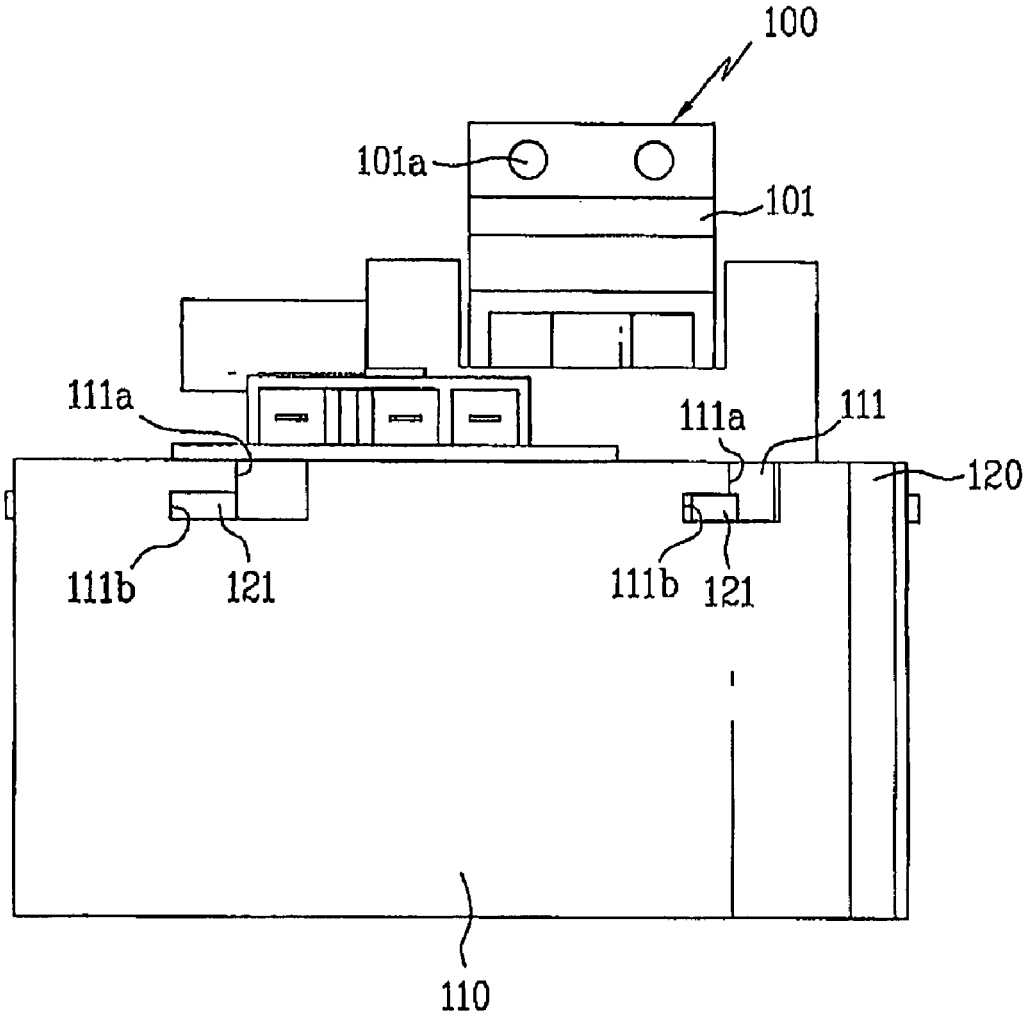

Referring to FIGS. 10*a* and 10*b*, the engaging process between the upper case and the lower case having the aforementioned configurations will now be described.

As illustrated in FIG. 10*a*, the projection 121 of the upper case 120 is inserted into the inserting groove 111*a* of the two-step groove part 111 formed on the lower case 110, to engage the upper case 120 to an upper portion of the lower case 110.

Similarly to the second sealing member of the first embodiment, a second sealing member of the second embodiment is provided on a portion, where the upper case 120 contacts the lower case 110. Because of the thickness of the second sealing member, the upper case 120 and the lower case 110 are spaced from each other by a predetermined distance. In this example, an end of the pressure part 130 presses against or contacts an upper end of the plate heater 140.

The upper case 120 is pressed to the lower case 110 so that the upper case 120 closely contacts the lower case 110. The pressure part 130 presses the plate heater 140. As a result, the pressed plate heater 140 transforms the first sealing member 150 beneath the plate heater 140, such that sealing within the lower case 110 is complete.

Once the upper case 120 is rotated, as shown in FIG. 10*b*, the projection 121 of the upper case 120 is engaged to the engaging groove 111*b*, such that the engagement between the upper case 120 and the lower case 110 is complete.

Therefore, it is relatively easy to engage the upper case to the lower case.

Alternatively, the projection 121 and the two-step groove part 111 may be formed on the lower case 110 and the upper case 120, respectively.

It will be apparent to those skilled in the art that various modifications and variations can be made in the present invention without departing from the spirit or scope of the invention. Thus, it is intended that this invention covers modifications and variations of the present invention provided that they come within the scope of the claims and their equivalents.

What is claimed is:

1. A steam generator comprising:

an upper case;

a lower case having a bottom, the bottom having an opening;

a heater to directly heat water in the steam generator, the heater configured to be placed between the upper case and the lower case to block the opening;

at least one first sealer placed between one of the cases and the heater; and fasteners to fasten the upper case to the lower case so firmly for the sealer as to be in tight contact with the heater and the one of the cases.

2. The steam generator of claim 1, wherein the heater includes a plate heater having a thin body and a heating wire installed on the thin body.

3. The steam generator of claim 2, wherein the upper case has a pressure part extending downward and the first sealer and the plate heater are placed between the pressure part and the bottom of the lower case.

4. The steam generator of claim 3, wherein the pressure part includes a plurality of legs.

5. The steam generator of claim 3, further comprising a second sealer placed between the upper case and the lower case.

6. The steam generator of claim 5, wherein the upper case has a rim and the second sealer is placed between the rim and the lower case.

7. The steam generator of claim 2, wherein the plate heater has a drain hole through water in the steam generator is drained.

8. The steam generator of claim 7, wherein the plate heater slopes down toward the drain hole.

9. The steam generator of claim 1, wherein the fasteners includes screws.

10. The steam generator of claim 1, wherein the fasteners includes:

a plurality of projections extending from one of the cases; and a plurality of grooves formed in the other of the cases, each of the grooves having an inserting groove through which one of the projections is inserted and an engaging groove in which the inserted projection is engaged after rotated.

11. The steam generator of claim 1, further comprising:

a water level sensor provided mounted the upper case to sense a water level; and a partition wall around the sensor.

12. The steam generator of claim 1, further comprising a fixing bracket connected to the upper case or the lower case for fixing the steam generator to an appliance.

13. The steam generator as claimed in claim 12, wherein the fixing bracket comprises a bent part for being engaged to a fastening hole of the appliance.

14. A drum-type washing machine comprising the steam generator of claim 1.

15. A steam generator comprising:

an upper case having a pressure part extending downward and a rim around the pressure part;

a lower case having a bottom having an opening and a side wall extending upward from the bottom;

at least one first sealer placed on the bottom of the lower case;

a heater to directly heat water in the steam generator, the heater configured to be a bottom of the steam generator and placed on the at least one first sealer; and a second sealer placed between the rim of the upper case and the side wall of the lower case.

16. The steam generator of claim 15, wherein the heater includes a plate heater having a thin body and a heating wire installed on the thin body.

17. The steam generator of claim 15, further comprising fasteners to fasten the upper case to the lower case so firmly for the first and second sealers as to be pressed.

18. The steam generator of claim 17, wherein the fasteners includes:

a plurality of projections extending from one of the cases; and a plurality of grooves formed in the other of the cases, each of the grooves having an inserting groove through which one of the projections is inserted and an engaging groove in which the inserted projection is engaged after rotated.

19. The steam generator of claim 17, wherein the fasteners includes screws.

20. A drum-type washing machine comprising the steam generator of claim 15.

21. A steam generator comprising:

an upper case;

a lower case;

a heater to form a chamber for holding water and generating steam with the upper case and the lower case, the heater configured to directly heat water in the chamber and to be placed between the upper case and the lower case;

at least one sealer placed between one of the cases and the heater; and fasteners configured to fasten the upper case to the lower case so as to make the sealer be in tight contact with the heater and the one of the cases.

* * * * *